United States Patent [19]

Koster et al.

[11] Patent Number: 4,934,312

[45] Date of Patent: Jun. 19, 1990

[54] RESIN APPLICATOR DEVICE

[75] Inventors: Charles H. Koster, Alvin; A. C. Hill, Navasota, both of Tex.

[73] Assignee: Nu-Bore Systems, Alvin, Tex.

[21] Appl. No.: 232,141

[22] Filed: Aug. 15, 1988

[51] Int. Cl.[5] ..... B05C 1/04; B05C 5/02

[52] U.S. Cl. ..... 118/410; 118/419; 156/184

[58] Field of Search ..... 118/50, 674, 679, 683, 118/419, 407, 325, 266, 269, 405, 410, 672, 668; 156/184 X

[56] References Cited

U.S. PATENT DOCUMENTS

| | | | |
|---|---|---|---|
| 1,929,877 | 10/1933 | Bonamico | 118/419 |
| 3,931,786 | 1/1976 | Teed | 118/672 |
| 4,299,186 | 11/1981 | Pipkin et al. | 118/419 |
| 4,412,506 | 11/1983 | Morita et al. | 118/683 |
| 4,431,690 | 2/1984 | Matt et al. | 118/674 |
| 4,445,458 | 5/1984 | O'Brien | 118/410 |
| 4,748,545 | 5/1988 | McIntyre | 118/410 |
| 4,773,962 | 9/1988 | Garrigue et al. | 118/266 |

*Primary Examiner*—Willard Hoag

*Attorney, Agent, or Firm*—Hopgood, Calimafde, Kalil, Blaustein & Judlowe

[57] ABSTRACT

Directed to a device for spreading an adhesive uniformly across a strip material comprising a container for strip to be coated, a pressurizable container for holding the adhesive, which is preferably a thermo-setting epoxy, a flexible tube connecting the adhesive container to an applicator head leading through a positive displacement meter. A feeder roll actuated by withdrawal of strip from the device operates the meter such that adhesive is applied only when strip is being withdrawn. The applicator head is provided with a slot through which adhesive is supplied from the interior of the applicator.

6 Claims, 2 Drawing Sheets

RESIN APPLICATOR DEVICE

In a co-pending U.S. patent application Ser. No. 144,516, filed Jan. 15, 1988, a device and method for providing a new bore in corroded or otherwise failed oil well casings and like cylindrical passages for petroleum products and other liquids has been described. Central to the device and method of the invention there described is the concept of wrapping a downhole tool having a mandrel section provided with upper and lower packers with multiple layers of thin, strong metallic strip made of a corrosion resistant alloy such as beryllium copper or other metal having the requisite combinations of properties including strength and corrosion resistance to survive for an extended period in the liquid surrounding to be encountered. The spirally-wrapped strip is fastened by collar means about the upper and lower packers and can be lowered into the well with little danger that the wrapped strip will become detached before the tool is brought to the position in the well where the bore is to be repaired. At that point, the lower packer is inflated to break the lower collar, and the strip is unwrapped to form a contact with the bore. The upper packer is then inflated. It is considered necessary from a number of standpoints to provide intermediate layers of a hardenable resin between the metal layers. Thus, it is greatly to be desired that the metal layers be firmly adhered together by a uniform layer of resinous material which can be hardened in situ. Such adherence can improve the seal of the new bore, which must withstand a pressure test. Furthermore, a uniform layer of resinous material can provide electrical insulation between the metal layers and resist galvanic reactions. Preferably, the resin to be used is thermo-setting so the polymerization thereof can be accomplished by means of hot water pumped down the well.

In seeking to achieve the necessary objectives, many problems were encountered. For example, it was found difficult to achieve a uniform layer of the resin between the metal layers. Even when applied uniformly, there was a tendency to form extended pockets of resin, with diminished coverage in other areas. It was found that pre-coated materials were difficult to handle in the field, and that the crews disliked getting resinous materials on tools, clothing and other equipment since clean-up in the field was especially difficult.

It was also found that with preferred materials, such as thermo-setting epoxies, the pot life was quite short, so that attempts to deal with pre-coated strip materials which could be applied at the same time as the strip materials, ran the risk of premature set which would prevent successfully completing an attempted patch. It was found that some personnel were allergic to liquid resinous materials if skin contact was made therewith. It was concluded that clean-up of equipment in the field was altogether impractical.

BRIEF DESCRIPTION OF THE INVENTION

In accordance with the invention, a resin-impregnated permeable strip, e.g., screen, is formed on the strip wrapping machine at the same time the strip is wrapped about the mandrel so that alternate layers of metal strip and of resin-impregnated strip are wound about the mandrel. The resinous material is kept confined almost to the point of application of the strip material upon the mandrel and a resin-impregnated strip of great uniformity in thickness is obtained. These objectives of the invention are obtained by mounting upon the wrapping machine a device comprising a frame provided with a container for impregnatable strip, e.g., screen, which is withdrawn from the container by rotation of the wrapping machine about the mandrel, a container for resinous liquid material which may be pressurized by a gas, e.g., air, a flexible tube connecting the resin container to an applicator head through a positive displacement meter such that rate of application of the liquid resin to the impregnatable strip is governed by the travel rate of the strip. Since application of the wrapping material as contemplated in the aforedescribed patent application is accomplished intermittently, no feed of resin occurs when the wrapping machine is not in a wrapping mode. The resin applicator itself consists of a tube bearing a longitudinal slot for feeding a layer of liquid resin to the impregnatable strip extending perpendicularly across the width of the strip. A platen is provided in combination with the resin applicator such that the strip or screen to be impregnated passes between platen and applicator. A roller having a rubber or plastic cover and actuated by passage of the impregnatable strip or screen thereover drives the metering device and thus coordinates the rate of resin feed with the rate of application of the resin-impregnated strip. When the drive stops, resin supply stops, thereby preventing leakage and wastage of liquid resin.

DETAILED DESCRIPTION OF THE INVENTION

Figure 1:
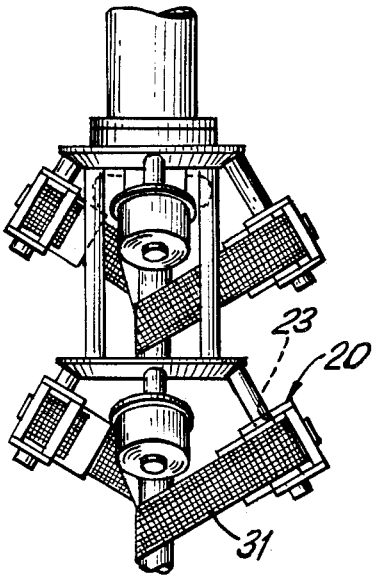
FIG. 1 depicts in elevation the device of the invention.
Figure 1:
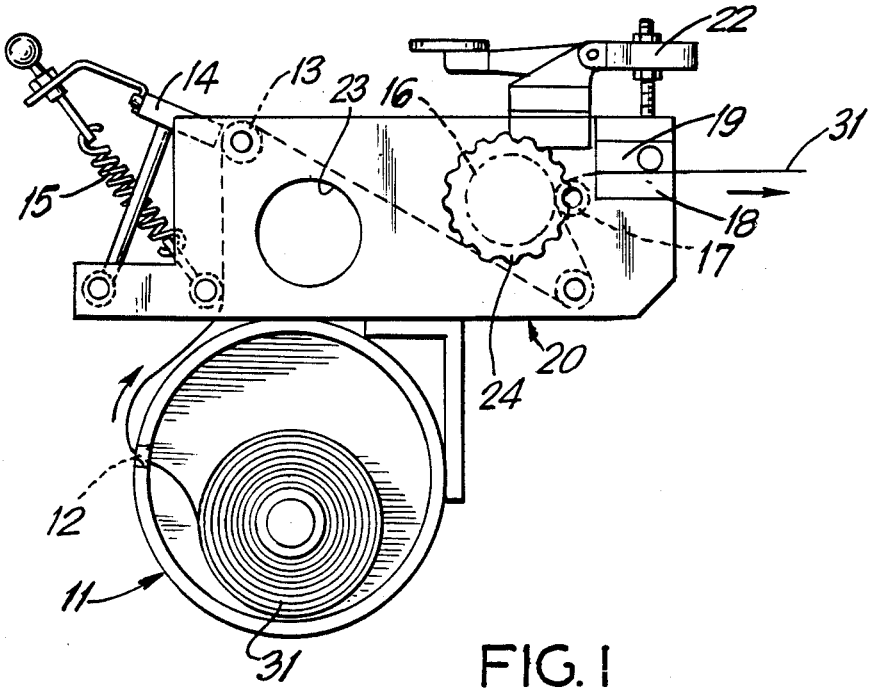

The invention will now be described in conjunction with the drawing which depicts a device in accordance with the invention adapted for mounting on a spindle of a machine for wrapping strip material about a mandrel. FIG. 1 of the drawing shows the device in elevation wherein reference character 11 shows a container, usually cylindrical, for holding a coil of strip material 31 to be coated with adhesive. The strip will advantageously be a plastic or fiberglas screen material. The strip is led through slot 12 around roller 13 which is provided with a pressure plate 14, which may be spring loaded by spring 15 to act as a brake in strip material 31 passing through the device. The strip is then led around friction roller 16, which may have a pinch roll 17 to hold the strip material thereagainst. The strip 31 is then led between platen 18 and a slotted adhesive dispenser 19 to apply adhesive to the strip material. Platen 18 and dispenser 19 may be mounted on body 20 by guide pins 21 and held in place by quickacting clamps 22. Body 20 is adapted to be mounted on a spindle of a wrapping machine by means of hole 23.

Driving force to operate the device is provided by withdrawal of adhesive-coated or impregnated screen strip past the dispenser 19.

Figure 2:
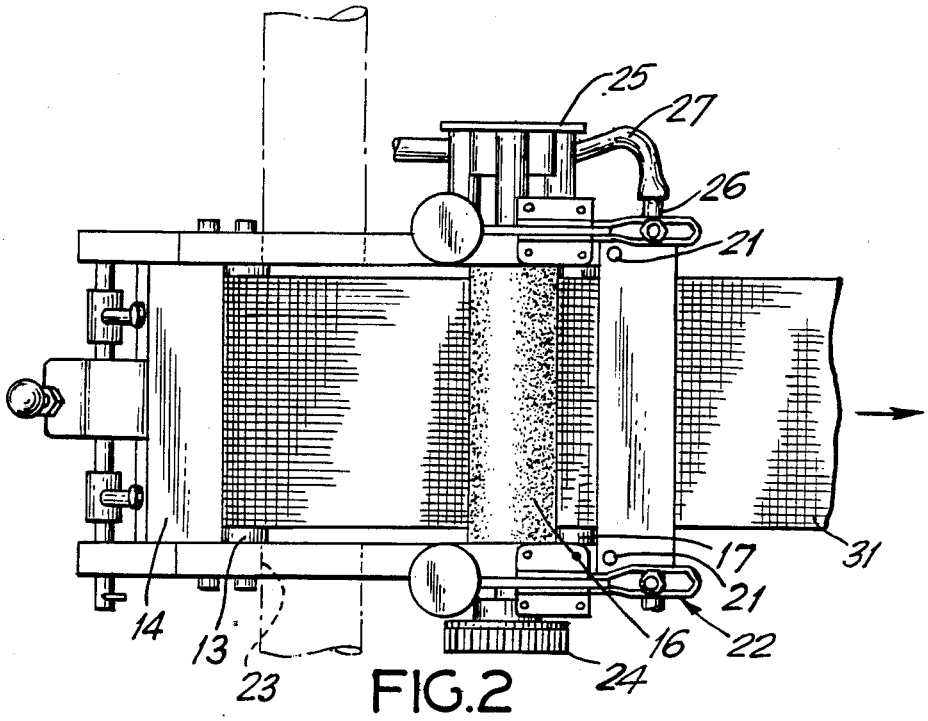
FIG. 2 depicts in plan view the device of the invention.

FIG. 2 shows the device of the invention in plan view. Guide roller 13 and pressure plate 14 are again shown, as is friction roller 16, which is provided at one end by a hand wheel 24 for feeding strip material by hand and which on the other end drives metering device 25 which may comprise a peristaltic pump or other positive displacement device. Dispenser 19 is shown as are guide pins 21. Dispenser 19 is provided with a nozzle 26 for feeding liquid adhesive thereto, preferably from the bottom end of dispenser 19.

Figure 3:
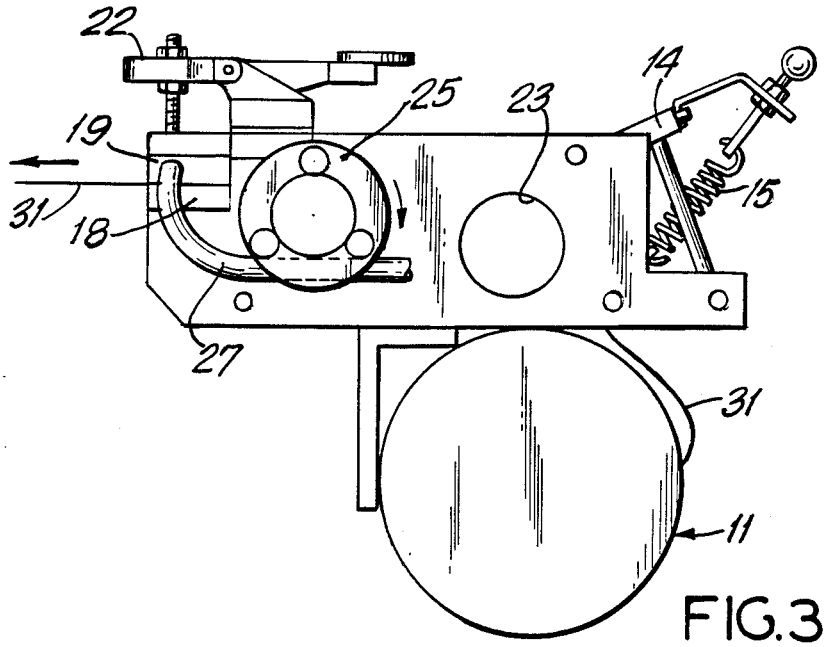
FIG. 3 depicts in elevation the opposite side of the device of the invention from that shown in FIG. 1.

FIG. 3 shows in elevation the opposite side of the device from that shown in FIG. 1. Peristaltic pump 25 is depicted provided with rollers 26 which pinch flexible tube 27 containing liquid adhesive from a pressurized container holding the same and force feed liquid adhesive through tube 27 to dispenser 19.

Figure 4:
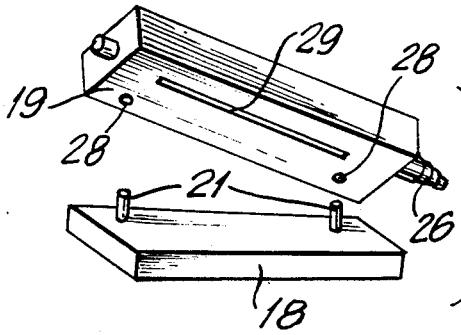
FIG. 4 depicts the platen and dispenser combination for spreading adhesive as described herein.

FIG. 4 shows the platen 18 and dispenser 19, with their matching faces exposed. Platen 18 and dispenser 19 are provided with holes 28 which enable mounting on guide pins 21. Dispenser 19 is a tube provided with a slot 29 which communicates to the interior of the dispenser and permits feed of liquid adhesive to the permeable strip material being drawn perpendicularly past slot 29. Nozzle 26 facilitates connection of tube 27 bearing liquid adhesive to dispenser 19. The platen and dispenser combination facilitates spreading of the adhesive. Preferably the platen and dispenser are made of Teflon.

As noted hereinbefore, the device of the invention is particularly adapted to be used in the device and method described in U.S. patent application No. 144,516, filed Jan. 15, 1988 for repairing and rejuvenating the bore of an oil well or similar cylindrical passage. The objective of that invention is to apply spirally-applied layers of strip material, preferably thin metallic strip material having high strength and corrosion resistance. It is considered highly advantageous in that invention that a uniform layer of an adhesive, such as an epoxy be placed between the metallic strip layers so that setting of the adhesive will adhere the layers together. The requirements to be met include application of a precise and uniform layer of thermosetting adhesive between layers of the primary liner material (beryllium copper for instance); to provide a uniform spacial dimension between layers of the primary lining material so the adhesive would not be squeezed away from one area only to assume extended pockets of adhesive in other areas; to provide for easy loading of the adhesive material into the apparatus; to provide for easy clean-up under field conditions; and to perform to these standards regardless of tool operating speeds. These objectives and requirements are fulfilled by operating in accordance with the present invention. The rotation speed of the friction roller and output of the metering unit are related directly to machine speed, and uniform application of liquid adhesive to the permeable material is achieved regardless of machine speed. All resinhandling equipment designed in accordance with the invention can simply be discarded after use, thereby eliminating clean-up problems in the field.

We claim:

1. A device for spreading a substantially uniform layer of viscous adhesive material upon a strip comprising a frame having mounted thereon a container for holding a coil of strip material, guide means for guiding said strip material from said coil to adhesive applicator means, positive displacement meter means actuable by movement of said strip, adhesive applicator means, container means for holding viscous liquid adhesive under pressure, adhesive passage means for conducting said adhesive from said adhesive container means through said meter means to said applicator means, whereby withdrawal of said strip past said applicator means spreads adhesive thereon.

2. A device in accordance with claim 1 wherein said guide means includes a plurality of rollers with a pressure pad bearable against at least one of said rollers.

3. A device in accordance with claim 1 wherein said positive displacement meter means comprises a peristaltic pump.

4. A device in accordance with claim 1 wherein said adhesive passage means comprises a flexible tube passing through said meter means such that flow of adhesive through said meter means is permitted only upon rotation of said roller means.

5. A device in accordance with claim 1 wherein said adhesive applicator means comprises a tube having a slot there along permitting flow of adhesive from the interior of said tube through said slot, said tube being located perpendicular to the longitudinal axis of said strip and of a length such that said slot extends completely across said strip.

6. A device in accordance with claim 5 wherein a platen is provided such that said strip passes between said platen and said slot.

* * * * *